US010821623B2

(12) United States Patent
Hare et al.

(10) Patent No.: US 10,821,623 B2
(45) Date of Patent: Nov. 3, 2020

(54) WALL HOLE PUNCH DEVICE AND METHOD

(71) Applicants: Charles W. Hare, Leaf River, IL (US); Marcus A. Smith, Chicago, IL (US)

(72) Inventors: Charles W. Hare, Leaf River, IL (US); Marcus A. Smith, Chicago, IL (US)

(73) Assignee: Restoration Tools, LLC, Rockford, IL (US)

( * ) Notice: Subject to any disclaimer, the term of this patent is extended or adjusted under 35 U.S.C. 154(b) by 0 days.

(21) Appl. No.: 14/951,682

(22) Filed: Nov. 25, 2015

(65) Prior Publication Data

US 2017/0144323 A1 May 25, 2017

(51) Int. Cl.
*B26F 1/38* (2006.01)
*B26F 1/44* (2006.01)
*B26F 1/32* (2006.01)

(52) U.S. Cl.
CPC ..... *B26F 1/3846* (2013.01); *B26F 1/32* (2013.01); *B26F 1/44* (2013.01); *B26F 2001/4481* (2013.01)

(58) Field of Classification Search
CPC .. B26F 1/3846; B26F 1/32; B26F 1/44; B26F 2001/4481; E04G 23/00; E04F 19/04
See application file for complete search history.

(56) References Cited

U.S. PATENT DOCUMENTS 640,696 A * 1/1900 Pearl ..... B26F 1/32 30/368
889,409 A * 6/1908 Spalding ..... B25D 5/00 30/367
1,004,193 A * 9/1911 Mowlds ..... B25D 17/02 125/41
1,174,433 A * 3/1916 Plaisted ..... B25D 17/02 175/418
1,540,860 A * 6/1925 Pobanz ..... B21D 28/34 30/360
2,122,368 A * 6/1938 Engler ..... B26F 1/44 83/862

(Continued)

FOREIGN PATENT DOCUMENTS

WO WO-2013177635 A1 * 12/2013 ..... B26F 1/32

OTHER PUBLICATIONS

Jon-Don, "Drying Wall Cavities and Cabinets Damaged by Water" Website [online], Aug. 28, 2015, retrieved from the Internet <URL: http://www.jondon.com/how-to/technical-tips/restoration-disaster-recovery/flood-recovery/drying-wall-cavities.html>.

(Continued)

*Primary Examiner* — Jonathan G Riley
(74) *Attorney, Agent, or Firm* — Hinshaw & Culbertson LLP

(57) ABSTRACT

A wall hole punch device is provided. The punch device has a wall-engaging surface, a floor-engaging surface, and a punch. The punch has a punching end, which generally has an angled face for pushing the chad downwardly and away from the hole. The bottom of the punching end is high enough to clear typical base plates when the punching device is used as intended. The top of the punching end is low enough so that the hole can be covered by baseboards of conventional height. A method of punching holes in walls and a method of drying walls using the device are also provided.

26 Claims, 3 Drawing Sheets

(56) References Cited

U.S. PATENT DOCUMENTS 2,757,457 A * 8/1956 Ziegelski, Sr. ..... B25D 5/00 33/671
3,244,241 A * 4/1966 Ferwerda ..... B25D 11/10 173/105
3,273,241 A * 9/1966 Townsend ..... B21D 28/34 30/360
3,791,041 A 2/1974 Phillips
3,888,068 A * 6/1975 Zambrano ..... B26F 1/3846 30/358
3,906,828 A 9/1975 Suzuki
3,920,259 A 11/1975 Graham
4,069,586 A * 1/1978 Skelton ..... B25D 5/00 30/360
4,087,913 A * 5/1978 Jackson ..... B26F 1/386 30/360
4,448,339 A * 5/1984 Pettigrew ..... B25C 3/006 227/147
4,713,886 A * 12/1987 Ikeda ..... B26F 1/32 30/361
4,713,995 A 12/1987 Davi
4,730,395 A * 3/1988 Blessing, Sr. ..... B23B 51/0426 30/360
4,848,309 A * 7/1989 Alderete ..... B25D 3/00 125/40
4,969,269 A * 11/1990 Dominguez ..... B26D 5/16 30/360
5,176,057 A * 1/1993 Chun ..... B21D 45/006 83/139
5,222,303 A * 6/1993 Jardine ..... G01B 3/02 33/528
5,282,564 A * 2/1994 Vigil Rio ..... B05C 17/00569 227/132
5,797,189 A 8/1998 Gilbert
5,946,809 A * 9/1999 Bright ..... B26F 1/32 30/305
6,109,086 A * 8/2000 Gambrel ..... B21D 19/088 72/325
6,484,408 B1 11/2002 Dove
7,159,747 B1 * 1/2007 Tanner ..... B25C 1/02 227/139
7,437,830 B1 * 10/2008 Kulavic ..... B25H 7/04 33/562
7,454,844 B1 * 11/2008 Ruby ..... B25H 7/02 30/358
7,475,585 B1 * 1/2009 Lill ..... E02D 29/14 72/466.4
2002/0046633 A1 * 4/2002 Borowczak ..... B26D 7/1818 83/13
2003/0204957 A1 11/2003 Eldar
2006/0117577 A1 * 6/2006 King ..... B26F 1/32 30/368
2007/0107237 A1 * 5/2007 Long ..... B25D 5/00 30/360
2008/0298916 A1 * 12/2008 Jordan ..... B23B 51/02 408/214
2011/0072947 A1 * 3/2011 Prout ..... B21D 28/26 83/639.4
2017/0014883 A1 * 1/2017 Streen ..... B21D 1/065

OTHER PUBLICATIONS

International Searching Authority, International Search Report and Written Opinion, International Application No. PCT/US2018/063521, Feb. 9, 2017.

* cited by examiner

Fig. 1
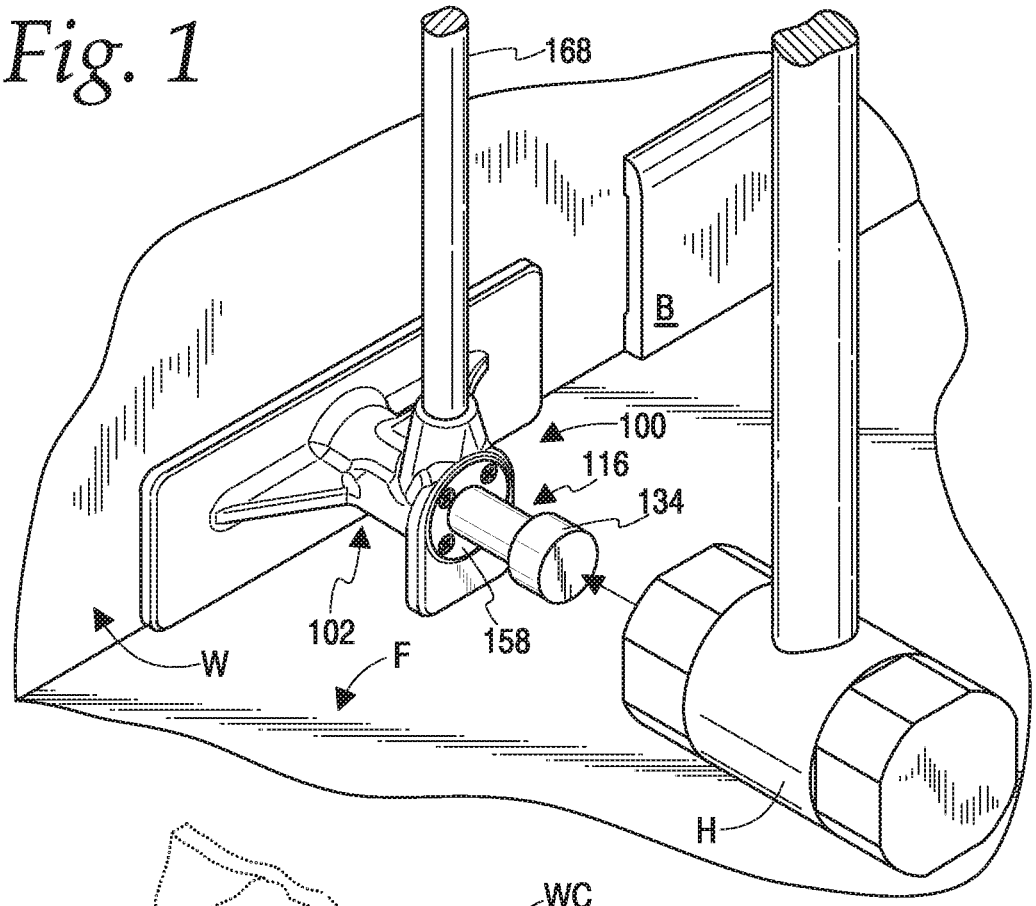
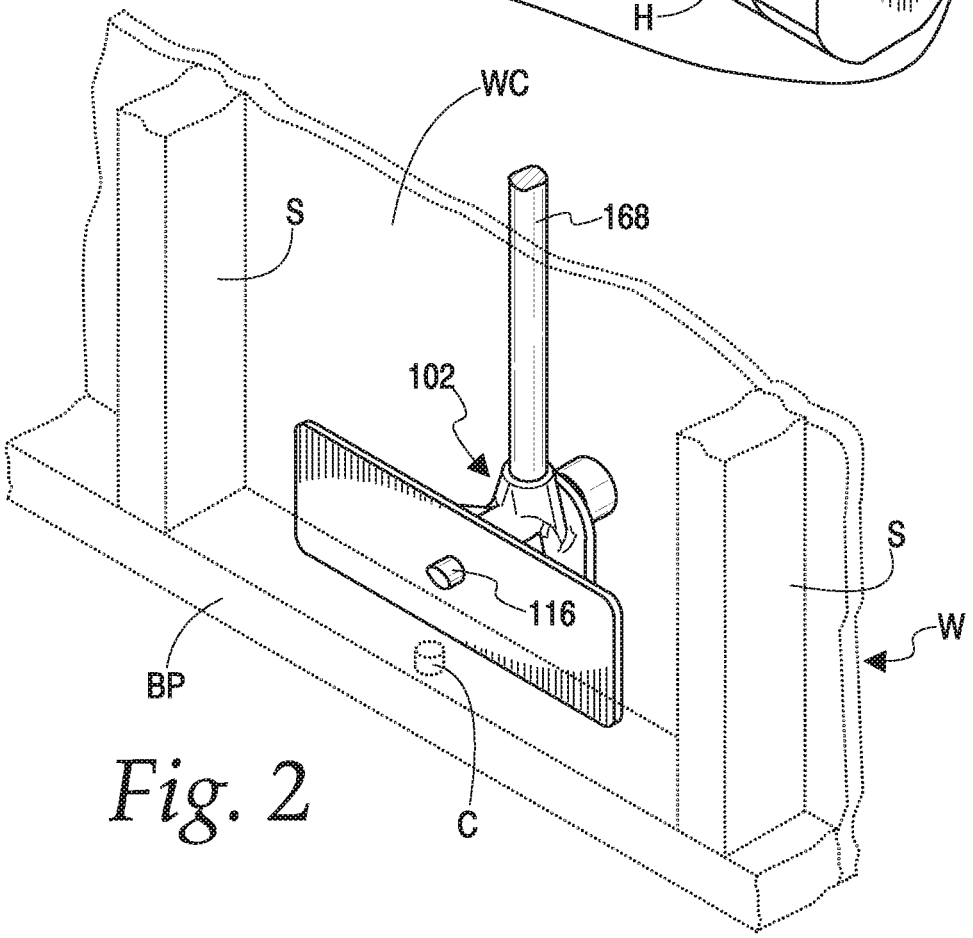
Fig. 2

WALL HOLE PUNCH DEVICE AND METHOD

FIELD OF THE INVENTION

The present invention relates to a wall hole punch device, a method of forming holes in a wall, and a method of drying a wall.

BACKGROUND

When a house or building, which may include a basement, is flooded, it is imperative to dry out any flooded areas as quickly as possible. This helps to avoid mold growth. Typically, the flooded area is first pumped out or otherwise removed, but typically water, whether as a liquid or absorbed in the wall or in some other form will remain in and behind walls that cannot be completely removed. Typically, some of this remaining water is trapped in the wall. For example, if the wall is made with drywall or plaster, the drywall or plaster has absorbed water as well as the wooden bottom plate and possibly the wall studs. To promote quick drying, baseboard is removed from a wet wall and holes are drilled in the wet wall in the area uncovered by the removal of the baseboard. Once the wall and space behind the wall has dried, the baseboard is reattached to the wall covering the holes.

Drilling the holes is very laborious and time consuming—typically requiring a worker to constantly bend over and work in a kneeling position. Typically, the driller has to get on at least one knee and bend over and/or crawl from one hole location to another to drill a hole. That process is repeated for each hole or for every several holes depending on hole spacing. One room can require many of these holes to be drilled because these holes may be spaced about 16 inches apart, corresponding to the spacing of the studs in the wall.

A need therefore exists for an efficient and less laborious method to form holes in a wall to permit relatively fast drying of the wall inside a building and for a tool to form holes in a wall.

SUMMARY OF THE INVENTION

In accordance with the present invention, a wall hole punch device, a method of punching holes in the wall and a method of drilling the wall is provided.

In accordance with one aspect of the invention, the wall hole punch device for forming a hole in a wall includes a housing having a bore, a wall-engaging surface for engaging a wall through which the hole is to be formed, a floor-engaging surface for supporting the punch device on the floor, with the housing, wall-engaging surface and floor-engaging surface in fixed relation to each other. A punch having a punching tip for forming a hole in the wall is located in the bore, the punch being movable in the bore such that the end (punching tip) of the punch is movable to an extended position outside the bore for a sufficient distance to form a hole through the wall and then to a retracted position away from the wall when the wall-engaging surface is disposed against a wall. Preferably, when in the retracted position, the punching tip does not extend outside the bore, as the punching tip can have a sharp edge to facilitate punching holes in walls. The bottom of the punching end of the punch while in the punching position is at least about 1.25 inches above a flat, planar surface when the punch device is placed on the flat, planar surface with the floor-engaging surface along the flat, planar surface. This arrangement helps to ensure that holes are properly and readily located at the lower end of the wall.

Efficient use of the punch device is further enhanced by providing an elongated handle that is secured to the housing, enabling the user to stand upright while positioning the punch device in the desired location on the floor or other supporting surface to place the punch device adjacent to the wall to which a hole is to be punched. A threaded hole or aperture or other structure may be provided in the housing to allow the handle to be secured thereto.

Typically, a punching force can be applied to the wall hole punch device with a hammer, which may be a sledgehammer or a similar tool, while the wall hole punch device is positioned in a desired location against a wall.

The punching end of the punch typically has a desired configuration for facilitating formation of the hole in a wall. In one embodiment, the punching end has a tip with the tip being located substantially at the top of the punching end when the punch device is oriented against the wall in a hole-forming position. More specifically, the tip may have an angle of between about 30° and 60° with the direction of movement between an extended position and a retracted position. In addition, the punching end may have a substantially flat cutting face with the aforesaid angular range. Thus, in another embodiment, the punch device has a flat cutting face that is angled downwardly.

In accordance with another aspect of the invention, the punch device further includes the compression spring or other retraction mechanism for retracting the punching end into its retracted position. In one embodiment, the spring can be located inside the bore and around the punch.

To minimize any potential electrical hazards, the punch, which typically can be constructed of metal, may have an electrically insulating section to prevent or inhibit conduction of electricity along the punch. In addition, the housing and wall-engaging surface can be formed of material that is electrically insulating, as could the entire wall punch device.

In embodiments having elongated handles, it is desirable for the handle to be oriented at an angle of from about 0° to about 10° from vertical with the handle extending away from the wall when the wall-engaging surface of the hole punch device is placed against the wall. This permits the user to readily grasp an upper portion of the handle without making contact with the wall when positioning the punch device against a wall and putting it in position to form a hole through the wall.

In another embodiment, the punch device may include structure for orienting and maintaining the orientation of the punch in the bore so that the punch tip is in a desired orientation when in use.

In accordance with still another aspect of the invention, a method of forming a hole in a wall is provided. The method is utilized typically with a punch device that includes a housing having a bore, a wall-engaging surface for engaging a wall in which a hole is to be formed or punched, a floor-engaging surface for supporting the punch device on a floor and a punch having an end for punching or otherwise forming a hole in the wall with the punch located in the bore and the punch being movable in the bore such that the end is movable between an extended position in which the end of the punch is located outside the bore and a retracted position wherein the punch is located at least partially within the bore. The method includes placing the punch device on a floor and against the wall with the floor-engaging surface contacting the floor and the wall-engaging surface against the wall. Thereafter, a hole is formed in the wall with the punch of the placed device, the hole being formed above a bottom plate in the wall. The hole typically is formed by punching the end of the punch through the wall to form a hole. The configuration of the punching end can be such that, depending on the type of wall material, the material removed from the wall when forming the hole is in the form of a chad that is pushed with the punch downwardly and into a cavity behind the wall.

Typically, after formation of the desired number of holes using the method as described above, the wall and the area behind the wall is permitted to dry. Drying can be facilitated by providing appropriate ventilation. After drying is completed, a baseboard can be attached to the wall along the floor covering the hole or holes that were formed by the punch device.

In accordance with another aspect of the invention, a method of drying a wet wall is provided. Typically, such walls are made from drywall, plaster and/or wood although the method is suitable for use on any type of wall that absorbs water and through which a hole can be formed with a punch device in accordance with the present invention. In accordance with the inventive method of drying a wet wall, a punch device is utilized of a type as described herein. The punch device is placed on the floor and against the wall through which a hole is to be formed, with the floor-engaging surface on the floor and the wall-engaging surface against the wall. Thereafter, a hole is punched, pierced or otherwise formed in the wall with the punch of the placed device while located above a bottom plate in the wall if such plate is present. After formation of the desired number of holes as described above, aeration of the wall and a cavity behind the wall occurs by the presence of the aforesaid hole or holes that are formed through the wall so that the wall dries. In accordance with this aspect of the invention, the method may further include pushing a chad with the punch downwardly and into a cavity in the wall. The method may further include striking a butt end of the punch with a hammer to cause the punch to advance towards and through the wall to form the hole through the wall.

The method of drying a wall may further include attaching a baseboard to the wall and along the floor covering the hole after drying has been accomplished to a desired amount.

In accordance with another aspect of the methods of the invention, a baseboard located at the lower portion of the wall is removed from the wall before the punch device is placed against the wall in the hole-forming position and the hole is formed in the region of the wall that was formerly covered by the baseboard. This arrangement allows the holes to be conveniently covered by the baseboard after drying.

In accordance with the methods of the invention, the placing and piercing or hole punching through the wall to aerate the wall can be repeated so that a desired number of holes are made through the wall to facilitate drying of the wall or the volume or space behind the wall.

BRIEF DESCRIPTION OF THE DRAWINGS

FIG. 1 is a perspective view of a wall hole punch device positioned against a wall and floor.

FIG. 2 is perspective view of the wall hole punch device of FIG. 1 viewed through the wall.

In FIG. 4, the device is shown in perspective, and in FIG. 5 the device is shown in cross-section.

DETAILED DESCRIPTION OF THE INVENTION

Figure 3:
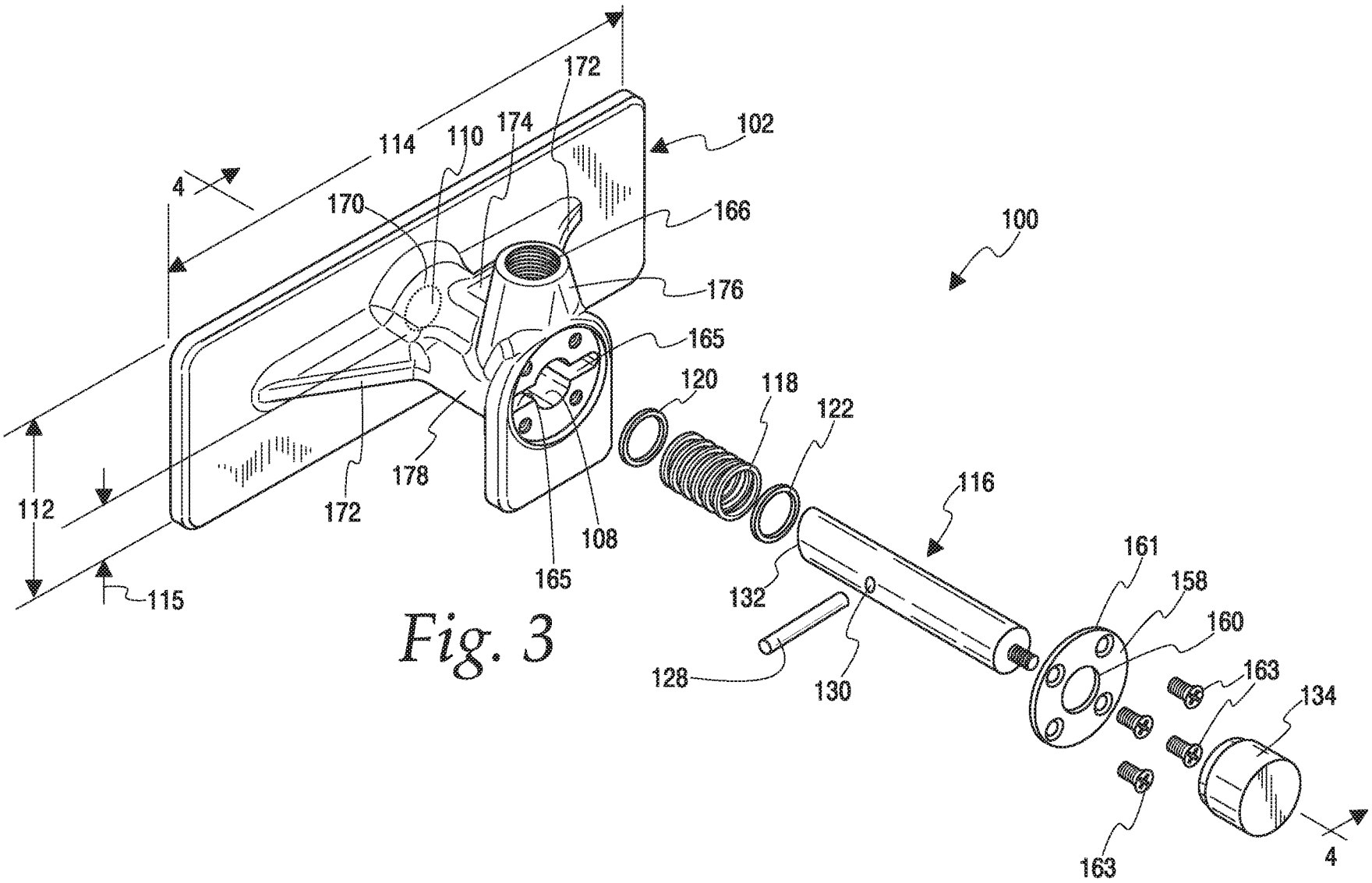
FIG. 3 is an exploded view of the wall hole punch device.

A first embodiment of a wall hole punch device 100 is discussed with reference to FIGS. 1-5. Wall hole punch device 100 includes a housing 102. Housing 102 provides a wall-engaging surface 104, a floor-engaging surface 106 and a bore 108. Wall-engaging surface 104 is substantially planar and has an opening 110 for bore 108. Wall-engaging surface 104 is generally rectangular having a height 112 and a width 114. The height of wall-engaging surface 104 generally exceeds 2" so that bore 108 is located above a bottom plate BP of a wall W. Typically, wall-engaging surface 104 is about 3.5" high or as otherwise desired so that opening 110 can be substantially centrally located within wall-engaging surface 104 and above bottom plate BP, which typically is nominally about 1.5" high. Width 114 is selected so that when combined with height 112 the area of wall-engaging surface 104 is sufficient to distribute the force of a hammer H over a sufficient area so as to avoid damage to wall W. Typically, width 114 can be approximately 10" or as otherwise desired to facilitate positioning wall hole punch device 100 parallel to wall W and to achieve the desired force distribution. Also, wall-engaging surface 104 is substantially flat so that wall-engaging surface 104 does not damage wall W with baseboard B removed adjacent where device 100 is used, as shown in FIGS. 1 and 2. Floor-engaging surface 106 has two separate portions 106*a* and 106*b*, but can have one large portion or three or more portions. One purpose of floor-engaging surface 106 is to stably support device 100 on floor F. As configured in this embodiment, when punch device 100 is placed on floor F with floor-engaging surface 106 on floor F, the bottom of opening 110 is at a distance 115 in the range of about 1.25" to about 2.5", preferably in the range of about 1.4" to about 2", and most preferably in the range of about 1.5" to about 1.7" above floor F. The top of opening 110 can be as desired but is less than 4", more typically less than 3", and in one specific embodiment about 2.25" above floor F. Of course, it is to be understood that the dimensions of wall hole punch device 100 can be as desired for a particular application.

Figure 4:
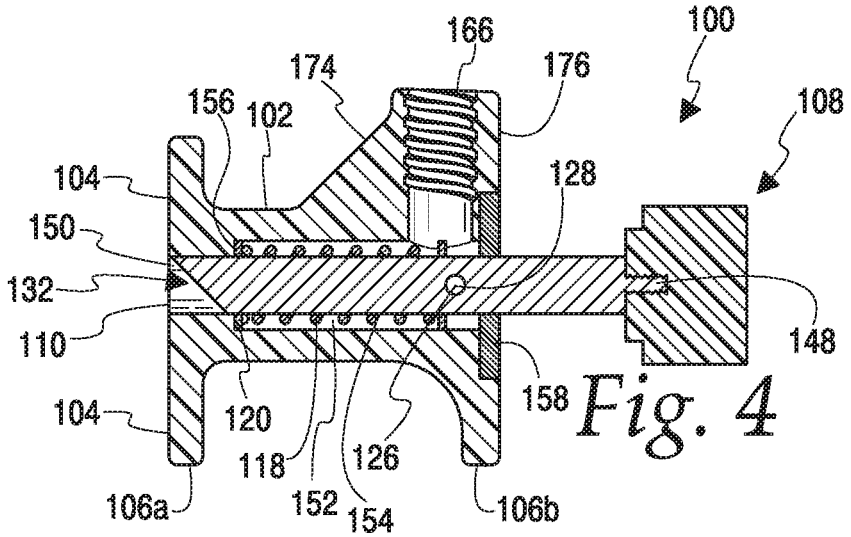
FIGS. 4 and 5 are cross-sectional views of the wall hole punch device along its central vertical plane.
Figure 5:
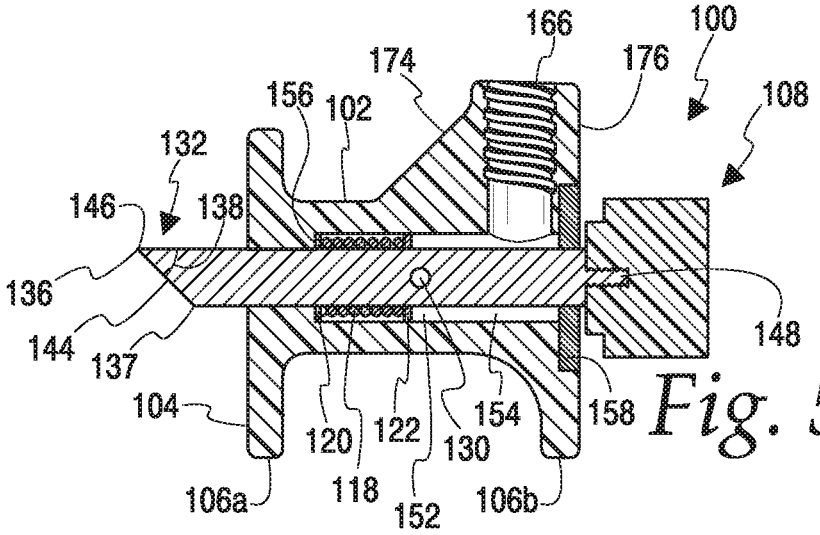
Figure 6:
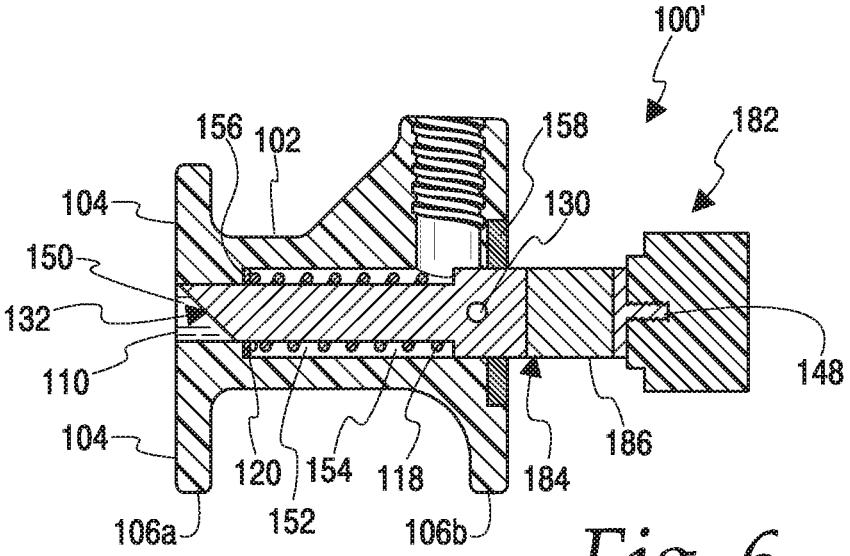
FIG. 6 is a cross-sectional view of the wall hole punch device along its central vertical plane but in an alternative embodiment of the device.

Wall hole punch device 100 also is composed of a punch 116, return spring 118, washer 120 and washer 122, all located within bore 108. Punch 116 optionally and as illustrated also has one or more side projections 126 for orienting the punch in the bore with the leading edge in a top center position as shown in FIGS. 2-6. Preferably, there are two opposed projections 126 that project sufficiently to engage washer 122 or spring 118 if washer 122 is absent. As illustrated, projections 126 are provided by a pin 128 inside a hole 130 located diametrically through punch 116. Projections 126 maintain the orientation of the punch within bore 108 as hereafter described. Other suitable structure for maintaining the orientation may be used such as punch 116 having any non-circular cross-section, e.g., oval, octagonal, rectangular, triangular or square, as non-limiting examples, and bore 108 having a corresponding cross-section. Return spring 118 may be any suitable type of spring and may be, for example, and as illustrated, a helical spring. Return spring 118 functions to maintain (absent a sufficient force to compress spring 118 to cause punch 116 to extend outwards from wall-engaging surface 104) and return punch 116 to the retracted or home position, as shown in FIGS. 4-6, FIGS. 4 and 6 illustrating punch 116 in the retracted or home position and FIG. 5 illustrating punch 116 in the extended position. Thus, return spring 118 should exert sufficient force on punch 116 to return punch 116 to the home position, such as after punching through a wall, for example. Return spring 118 has a suitable spring rate or constant to return punch 116 to the home position. Ends of spring 118 may be formed, ground or otherwise made flat or otherwise flattened.

Punch 116 has two ends, a working end 132 and butt end 134. Working end 132 is for punching a hole in a wall W. Any suitable surface shape can be utilized for working end 132. For example, as shown, working end 132 has an angled flat face and a peripheral tip 136 and a trailing portion 137. Typically, tip 136 may have an angled flat face, having an angle 138 of between about 30° to about 60°, preferably about 40° to about 50°, and most preferably about 45°, from a plane normal to the length or the longitudinal centerline 142 of punch 116. As shown, working end 132 has a substantially planar, angled face 144 including tip 136 and therefore the surface of face 144 has the uniform angle 138. Face 144 preferably has sharp edges to facilitate formation of holes. Face 144 is shown as being solid, but it need not be. It could have a void at its center, for example. Face 144 can be considered to be flat even if there is such a void. Typically, if there is a void it occupies less than 80% of face 144, more typically less than 70%, or less than 50%, or less than 33%. The circumference 146 of face 144 can be sharpened when needed by any suitable method as known by those skilled in the art, including, for example, grinding and filing. Tip 136 is oriented in punch device 100 so that it is located at the upper end of face 144, preferably at the 12 o'clock position. Flat face 144 with tip 136 being upwardly located has three important benefits. The first benefit of angled flat face 144 is that the punch generally does not require cleaning after punching a hole since the flat face 144 does not have raised cutting edges that tend to retain chads C or other debris from wall W. The second benefit is that if there is an obstruction in wall W along its bottom plate BP such as a conduit or electrical piping face 144 will tend to cause punch 116 to go over the obstruction lessening the likelihood and extent of damage to the obstruction. The third benefit is that if a hole is not cleanly punched through due perhaps to the wall being wet, the resulting chad C should fall downwardly away from the hole allowing aeration into a wall cavity WC because during a punch stroke of punch 116, the top of the wall adjacent tip 136 of punch 116 penetrates through wall W first, followed by the lower portions of face 144. Punch 116 may be made from any suitable material, typically a tough metal and may be, for example, steel, stainless steel, titanium and other suitable materials as are known to those skilled in the art.

End 134 is a butt end of punch 116. To facilitate the striking of butt end 134 with a hammer H, preferably butt end 134 includes a portion that is wider than the bore 108. Butt end 134 can be any suitable material including, for example, urethane. As shown, butt end 134 has a threaded female portion 148 allowing the butt end 134 to be replaced. Alternatively, butt end 134 can have a threaded male or female portion. Butt end 134 is preferably made from an electrically insulating material, which may be urethane, for example. Butt end 134 may extend into bore 108 for electrical insulating safety or punch 116 may have an additional insulating section (not shown). Depending on the application, the width or diameter of punch 116 is typically between about ⅜" and about 1", more typically between about 0.5" and about 0.75", and most typically about ⅝".

Bore 108 has substantially cylindrical sections 150 and 152. Section 150 is narrower, i.e., has a smaller diameter, than section 152. The diameter of punch 116 typically fits closely within bore section 150. Spring 118, washer 120 and washer 122 are located within bore section 152 and around punch 116.

Bore section 152 forms a compartment 154 having end wall 156. At the other end of compartment 154 is a retainer ring 158 having an internal circumference 160 and an external circumference 161. Circumference 160 fits snugly around punch 116. Preferably, butt end 134 is wider than circumference 160 and preferably narrower than circumference 161. Retainer ring 158 may be attached to housing 102 by any suitable means including, for example, a plurality of screws 163.

Along bore section 152 are one or more slots 165 for projections 126 to upwardly orient and retain tip 136 of punch 116. Two slots 165 are shown in in FIG. 3.

Housing 102 also has structure for attachment of a handle. An opening 166 for attachment of a handle 168 is provided in housing 102. Typically, opening 166 is threaded and the lower end of handle 168 has complementary threads. Handle 168 may be a conventional wooden, metal or plastic tool handle such as a handle for a broom or a plunger, for example, that is merely a straight elongated handle, allowing a user to position wall-engaging surface 104 of device 100 against a wall without requiring the user to bend over or kneel to position device 100 so that wall-engaging surface 104 is placed and maintained in position against a wall during use. Opening 166 is typically oriented so that handle 168 is at an angle of 0° to about 10°, preferably about 1° to about 6°, and most typically about 2.5° relative to vertical and away from the wall when wall hole punch device 100 is in position against a wall to form a hole in the wall. This angle provides adequate clearance from the wall for a hand holding the handle. If desired, the upper end of the handle can be offset to obtain desired clearance from the wall in addition to or in place of the offset from the handle mounting angle described above.

Housing 102 can have a body 170 through which bore 108 is located. Body 170 may be relatively narrow relative to wall-engaging surface 104 but should be of sufficient strength to withstand repeated wall punching operations. In that regard, housing 102 may have 2 or more buttresses 172 for strengthening body 170 and to restrict lateral movement, as well as a buttress 174 for buttressing an opening body 176 against relative movement toward the wall. Body 170 can also have one of more extents 178 for accommodating slots 165 along bore 108.

Body 170 may be made from a non-conductive, non-corrosive plastic, for example, crosslinked polyethylene having sufficient rigidity and toughness for this application. Other materials of any suitable type can be used, including metals, for example.

Punch device 100 may include any suitable sensor or sensors (not shown) for locating studs, pipes and wiring that are known in the art. The one or more sensors may be magnetic or be of the internal-capacitor type. Punch device 100 may use any suitable display or sound emitter devices to indicate the location of studs, pipes and wiring or the need to move punch device 100 away from a current location.

Punch device 100 may also have a plurality of vertically adjustable feet (not shown) to adjust the vertical spacing between floor F and bore 108. In that case, floor-engaging surface 106 could form or otherwise have mounted thereto the adjustable feet or other supports (not shown). Alternatively, rollers, casters, wheels or similar structure could provide the floor-engaging surface.

Punch device 100 may also include a line gauge for measuring the distance between an existing hole in the wall, typically made by punch device 100, and punch 116. The line gauge may be incorporated into device 100 by providing a slide mechanism in or on housing 102. The slide mechanism may be lockable so that a distance can be set that matches the spacing of studs S or some other desired distance.

Punch device 100 may include a cover (not shown) for storage of housing 102. If desired, the cover could cover the entire wall-engaging surface 104 and borehole. The cover could attach to wall-engaging surface 104 in a snap-lock arrangement. Preferably, the cover covers at least the area from which punch 116 extends and has enough depth to accommodate a full extension of punch 116.

A second embodiment of a punch device 100' is described with reference to FIG. 6. Punch device 100' is identical to punch device 100 where like reference numerals denote like elements, except for the structure of punch 182. Punch 182 is identical to punch 116 except that punch 182 was a wide section 184 that substitutes for washer 122. In addition, wide section 184 has an electrically insulating section 186 to prevent conduction of electricity from tip 136 in the event tip 136 contacts a live electrical wire.

Operation of the punch device 100 will now be described with reference to FIGS. 1-5. Punch device 100 is placed against wall W and on floor F as shown in FIG. 1. Punch 116 is in a fully retracted position as shown in FIG. 4. In this position, spring 118 is relaxed and butt end 134 is away from body 170 and ring 158. Next, a hammer H, typically a sledgehammer, is swung towards wall W and then strikes butt end 134 as shown in FIG. 1 until hammer H strikes butt end 134 with desired force to punch a hole through wall W. When butt end 134 is properly struck by hammer H with sufficient force, punch 116 is driven through, and punches a hole, in wall W, and the punched-through portion of wall W, chad C, is deposited into wall cavity WC as shown in FIG. 2. The momentum of hammer H causes punch 116 to move to the left relative to FIGS. 4 and 5 and pin 128 pushes on washer 122 which compresses spring 118. Compression of spring 118 slows down the movement of punch 116 into wall W. This movement is stopped when butt end 134 encounters retainer ring 158 as shown in FIGS. 2 and 5. Spring 118 then causes punch 116 to retract from wall W to the retracted position. The amount of penetration of trailing portion 137 into the wall typically may be about 0.5" to about 0.9", more typically about 0.6" to about 0.7", most typically about ⅝". Structure may be provided for adjusting the amount of penetration of punch 116 through wall W, which can be simply a replacement punch for punch 116 of a desired length, for example.

Instead of a hammer, punch device 100 may be operated with a lever using a rack and pinion mechanism (not shown), with a pivoting lever pushing on butt end 134 or attached to punch 116, with an electric motor or solenoid, or with a hydraulic mechanism.

In another embodiment of the invention, a method of punching holes in a wall is provided, typically with punch device 100 previously described. The method includes placing a punch device (which may be a punch device such as punch device 100, for example) on a floor and against a wall with the floor-engaging surface of the device on the floor and the wall-engaging surface of the device against the wall. Next, a hole is formed in the wall with a punch of the placed punch device above a bottom plate in the wall. Typically, a body of material from the wall, i.e., a "chad" is formed by the punching action. The wall is typically made from drywall, plaster and/or wood or plastic, for example, although the invention is not limited to such types of walls. The wall typically has at least one cavity formed by studs. The method may also include pushing the chad from the hole with the punch downwardly and into a cavity in the wall, which may occur when the punch is properly configured. Optionally, the method includes attaching a baseboard to the wall along the floor covering the hole without patching the hole. The hole may be pierced by striking a butt end of the punch with a suitable implement, which may be, for example, a hammer or sledgehammer.

In another embodiment of the invention, a method of drying a wall is provided. Typically, the wall is wet because of flooding, water seepage, or leaking plumbing or some other event. Generally, the wall has a frame including a base plate and studs (wood or steel, for example), a drywall, plaster and/or wood or other material covering over one or both sides of the frame, and one or more cavities. The method of drying walls generally includes the above method of punching a hole. Typically, a plurality of holes is formed at intervals around the length of the wall, or around the perimeter of the room, or area, to be dried. The intervals may be uniform or regular intervals as desired. Additionally, the method of drying walls includes allowing aeration of a cavity in the wall through the hole so that the wall around the hole and around the cavity dries out. Drying of the wall may be assisted by ventilating the room from which the piercing of the wall was performed. Additionally, the method may include removing a baseboard (wood or plastic, for example) before forming the hole(s). The placing and piercing steps may be repeated so that multiple holes are pierced in the wall for different wall cavities to better dry the wall by allowing aeration through the multiple holes. Where multiple holes are pierced in the same wall, the holes are typically spaced about 16" apart to match the spacing of the studs.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A punch device for forming a hole in a wall, the punch device comprising:

a housing having a bore, a wall-engaging surface for engaging the wall, the wall-engaging surface extending horizontally on either side of the bore, a floor-engaging surface for supporting the punch device on a floor, the bore, wall-engaging surface and floor-engaging surface in fixed and non-adjustable relation to each other; and a punch having a punching end for punching the hole in the wall, the punch located in the bore, the punch being movable in the bore such that the punching end is movable from a retracted position to an extended position outside the bore by a hammer blow on the punch toward the wall, the punching end not extending beyond the bore when the punching end is in the retracted position; and a compression spring which opposes the motion of the punch from the retracted position to the extended position; wherein a bottom of the punching end in the retracted position is at least about 1.25 inches above a flat, planar surface when the punch device is placed on the flat, planar surface with the floor-engaging surface along the flat, planar surface;

wherein the bore has a bore opening for the punch, the top of the bore opening being less than 4 inches above the flat, planar surface when the punch device is placed on the flat, planar surface with the floor-engaging surface along the flat, planar surface;

wherein the punching end first pierces the wall as the punch moves from the retracted position towards the extended position;

wherein the punching end has a substantially planar cutting face extending horizontally across the bore and vertically across the bore to a top edge of the punching end;

wherein the hammer blow has a force, and the wall-engaging surface is substantially flat and transmits a portion of the force transmitted by the compression spring to the wall.

2. The punch device of claim 1 wherein the cutting face makes a downward angle of between about 30° to about 60° with the direction of movement between the extended position and the retracted position.

3. The punch device of claim 1 wherein the punch also has an electrically insulating section.

4. The punch device of claim 1 wherein the housing and wall-engaging surface are electrically insulating.

5. The punch device of claim 1 further comprising an elongate handle, the handle at an angle of 0 to about 10 degrees from vertical, the handle angling upwardly away from the wall when the wall-engaging surface is placed against the wall.

6. The punch device of claim 1 wherein the punch is substantially cylindrical and the bore is substantially cylindrical at the wall-engaging surface.

7. The punch device of claim 1 wherein the floor-engaging surface is capable by itself of stably supporting the punch device on the floor with the punch in the retracted position and the wall-engaging surface against the wall.

8. The punch device of claim 1 wherein the housing has the floor-engaging surface and the wall-engaging surface.

9. The punch device of claim 1 wherein the punch has a width of about 0.375 inch to about 1".

10. The punch device of claim 1 wherein the wall-engaging surface has an area of 20 to 35 square inches.

11. A punch device for forming a hole in a wall, the punch device comprising:

a housing having a bore;

a wall-engaging surface for engaging the wall, the wall-engaging surface extending horizontally on either side of the bore, the bore extending through the wall-engaging surface;

a floor-engaging surface for supporting the punch device on a floor; and a punch having a punching end for punching the hole in the wall, the punch located in the bore, the punch being movable in the bore such that the punching end is movable from a retracted position to an extended position outside the bore, the punching end not extending beyond the bore when the punching end is in the retracted position, the punching end having a substantially planar cutting face and a leading tip at a top edge of the punching end, the cutting face extending horizontally across the bore and vertically from the top edge of the punching end across the bore and making a downward angle of between about 30° to about 60° with the direction of movement between the extended position and the retracted position;

wherein a bottom of the punching end in the retracted position is at least about 1.25 inches above a flat, planar surface when the punch device is placed on the flat, planar surface with the floor-engaging surface along the flat, planar surface;

wherein the bore has a bore opening for the punch, the top of the bore opening being less than 4 inches above the flat, planar surface when the punch device is placed on the flat, planar surface with the floor-engaging surface along the flat, planar surface;

wherein the tip first pierces the wall as the punch moves from the retracted position towards the extended position.

12. The punch device of claim 11 wherein the punch also has a projection orienting the punch in the bore.

13. The punch device of claim 12 further comprising a slot, the projection extending into the slot, the slot limiting the rotation of the punch in the bore.

14. The punch device of claim 11 wherein the punch is not rotatable relative to the floor-engaging surface such that the cutting face makes the downward angle.

15. The punch device of claim 11 wherein the punching end has a trailing portion substantially at the bottom of the punching end, the trailing portion penetrating at least 0.5" into the wall when the punch is in the extended position and the wall-engaging surface is against the wall.

16. The punch device of claim 11 wherein the punch is substantially cylindrical and the bore is substantially cylindrical at the wall-engaging surface.

17. The punch device of claim 11 wherein the cutting face has a circumference and the circumference is sharp.

18. The punch device of claim 15 wherein the trailing portion penetrates at most 0.9" into the wall when the punch is in the extended position and the wall-engaging surface is against the wall.

19. The punch device of claim 11 wherein the punch has a width of about 0.375 inch to about 1".

20. The punch device of claim 11 wherein the cutting face extends vertically entirely across the punch end.

21. The punch device of claim 11 wherein the punch device has a single substantially planar cutting face.

22. The punch device of claim 11 wherein the wall-engaging surface is substantially flat and has an area of 20 to 35 square inches.

23. A punch device for forming a hole in a wall, the punch device comprising:

a housing having a bore;

a wall-engaging surface for engaging the wall, the wall-engaging surface extending horizontally on either side of the bore, the bore extending through the wall-engaging surface;

a floor-engaging surface for supporting the punch device on a floor; and a punch having a punching end for punching the hole in the wall, the punch located in the bore, the punch being movable in the bore such that the punching end is movable from a retracted position to an extended position outside the bore, the punching end not extending beyond the bore when the punching end is in the retracted position, wherein a bottom of the punching end in the retracted position is at least about 1.25 inches above a flat, planar surface when the punch device is placed on the flat, planar surface with the floor-engaging surface along the flat, planar surface, wherein the wall-engaging surface has a bore opening for the punch, the top of the bore opening being less than 4 inches above the flat, planar surface when the punch device is placed on the flat, planar surface with the floor-engaging surface along the flat, planar surface, wherein the floor engaging surface has a portion proximal the wall-engaging surface and a portion non-proximal to the wall engaging surface and proximal an end of the punch opposed to the punching end when the punch is in the extended position, wherein the floor-engaging surface is capable by itself of stably supporting the punch device on the floor with the punch in the retracted position and the wall-engaging surface against the wall.

24. The punch device of claim 23 further comprising an elongate handle, the handle at an angle of 0 to about 10 degrees from vertical, the handle angling upwardly away from the wall when the wall-engaging surface is placed against the wall.

25. The punch device of claim 23 wherein the wall-engaging surface is substantially flat and has an area of 20 to 35 square inches.

26. The punch device of claim 23 wherein the punching end has a substantially planar cutting face extending horizontally across the bore and vertically across the bore to a top of the punching end and making a downward angle of between about 30° to about 60° with the direction of movement between the extended position and the retracted position.

* * * * *